United States Patent [19]

Bercier et al.

[11] Patent Number: 4,553,345

[45] Date of Patent: Nov. 19, 1985

[54] DISPLAY LETTER MOUNTING AND METHOD THEREFOR

[75] Inventors: John R. Bercier, Elmhurst; Thomas C. Cieslowski, Villa Park; Gary E. Delaquila, Glen Ellyn; James W. Leone, Elmhurst; Paul H. Mauersberger, Melrose Park, all of Ill.

[73] Assignee: Wagner Zip-Change Inc., Chicago, Ill.

[21] Appl. No.: 502,281

[22] Filed: Jun. 8, 1983

[51] Int. Cl.[4] ..... G09F 13/04

[52] U.S. Cl. ..... 40/576; 40/618; 40/564

[58] Field of Search ..... 40/564, 489, 490, 491, 40/558, 576, 575, 618, 611, 580

[56] References Cited

U.S. PATENT DOCUMENTS

| | | | |
|---|---|---|---|
| 931,188 | 8/1909 | Ellis | 40/576 |
| 1,217,192 | 2/1917 | Larson et al. | 40/618 |
| 1,271,044 | 7/1918 | Leech | 40/576 |
| 1,314,712 | 9/1919 | Sorenson et al. | 40/576 |
| 1,352,031 | 9/1920 | Schaffner | 40/576 |
| 1,384,387 | 7/1921 | Hinckley | 40/576 |
| 1,521,177 | 12/1924 | Friis et al. | 40/576 |
| 1,638,679 | 8/1927 | Buchanan | 40/553 |
| 1,775,725 | 9/1930 | Keith | 40/618 |
| 1,994,937 | 3/1935 | Berger | 40/618 |
| 2,587,368 | 2/1952 | Murphy | 40/618 |
| 2,632,270 | 3/1953 | Moss | 40/616 |
| 2,928,198 | 3/1960 | Madanick | 40/558 |
| 3,742,633 | 7/1973 | Palm | 40/576 |

FOREIGN PATENT DOCUMENTS

| | | | |
|---|---|---|---|
| 397163 | 2/1909 | France | 40/576 |
| 911415 | 7/1946 | France | 40/564 |

*Primary Examiner*—Gene Mancene
*Assistant Examiner*—James R. Hakomaki
*Attorney, Agent, or Firm*—Emrich & Dithmar

[57] ABSTRACT

A display letter mounting arrangement for use in an open face sign having a flat forward, or display, surface is disclosed. Each letter, or alphanumeric character, is provided on an individual flat panel which is inserted between generally horizontally oriented, parallel, upper and lower tracks. A high contrast, or illuminated, background screen is provided aft of the planar arrangement of letter panels which are positioned immediately adjacent one another. Each panel includes an opaque partition secured to a lateral edge of the panel along the length thereof so as to be positioned between immediately adjacent panels on the sign in an overlapping manner. Each partition, or inter-panel strip, has a cross section in the form of an "h", with the recessed portion thereof securely attached to the lateral edge of a panel permitting the extended portion of the partition to engage and overlap the proximal edge portion of an immediately adjacent panel. The partition eliminates inter-panel light leaks and provides for more stable letter mounting. The arrangement of the present invention is particularly adapted for reverse-type letters in combination with an illuminated, or high contrast, background.

6 Claims, 5 Drawing Figures

DISPLAY LETTER MOUNTING AND METHOD THEREFOR

BACKGROUND OF THE INVENTION

This invention relates generally to display signs and is particularly directed to a flat, multiple panel, alphanumeric character display having an illuminated, or high contrast, background.

Signs for displaying information in the form of alphanumeric characters or other form of symbology are well known and take on a variety of forms. Perhaps the most common form of this type of display involves the use of individual, replaceable panels each containing an individual symbol or alphanumeric character. The panels are typically mounted in the forward, open portion of a box-like frame and are held in position by means of generally horizontally oriented tracks attached to the front portion of the sign frame. The characters, or letters, are arranged in horizontal rows for presenting the message which the sign is intended to convey. The lettered panels are arranged in accordance with the desired message and may be easily removed from or relocated on the sign.

Signs of this type frequently make use of reverse-type letters wherein the letter, or symbol, is presented as a clear, or transparent, portion of the individual panel surrounded by an opaque panel portion for defining the letter. For increased visibility and definition, a background which is in high contrast with the opaque portion of the panels is provided aft of the panel array. In addition, frequently a source of illumination is provided aft of the background panel for nighttime viewing. For optimum clarity and resolution, the high contrast background should be visible only through the transparent portions of the lettered panels which define the individual symbols, or alphanumeric characters. Therefore, the forward surface of the sign should be free of "light leaks".

The prior art discloses various attempts to eliminate, or at least minimize, these light leaks, particularly in illuminated signs. U.S. Pat. No. 1,521,177 to Friis et al discloses an electrically illuminated sign including sign character openings which are divided into equal spaces or divisions by means of upright division bars which engage immediately adjacent glass sign character plates and stencil plates in an overlapping manner so as to attempt to reduce light leaks. The fixed inter-panel division bars are mounted as an integral part of the sign frame and will thus not accommodate panels of various widths. U.S. Pat. Nos. 2,632,270 to Moss and 3,742,633 to Palm disclose arrangements in which the opaque lateral edges of each letter panel are adapted to overlap and engage the facing lateral edge of an immediately adjacent letter panel so as to substantially reduce light leaks between letter panels. This approach requires the lateral edges of each panel to be formed into a complementary, interconnecting shape, such as by routing, and is therefore expensive and time-consuming. U.S. Pat. No. 1,638,679 to Buchanan discloses a circular sign arrangement including a plurality of individual stenciled letters or numbers each of which includes an extended portion located on a lateral edge of the stencil and adapted to fit under an adjacent stencil when assembled in a circular or linear array on the sign. In addition, metal clips may be positioned between adjacent stencil letters in an attempt to eliminate light leaks therebetween. This approach is limited in application to panels comprised of a malleable material such as metal and would be difficult and expensive to implement with some of the more common lettering materials in use today such as the harder plastics. U.S. Pat. No. 2,928,198 to Madanick illustrates yet another approach to a multi-letter illuminated sign.

The present invention is intended to overcome the aforementioned limitations of the prior art by providing an inexpensive, easily assembled, planar sign arrangement in which light leaks between adjacent letter panels are eliminated. The individual letter panels and inter-letter partitions affixed thereto are easily fabricated and assembled with the resulting combination easily installed in a conventional display sign.

SUMMARY OF THE INVENTION

The present invention contemplates a flat sign arrangement wherein a plurality of flat panels, each including either an alphanumeric character or a blank space, are positioned in close lateral arrangement on a front surface of the sign. Each panel includes an opaque strip, or partition, securely coupled to the lateral edge of the panel along the length thereof so as to abut and overlap an immediately adjacent panel. The inter-panel strips eliminate light leaks, provide for more stable letter mounting, and protect the sign panels from edge impact damage. Thus, it is an object of the present invention to provide for enhanced letter definition and visibility in a multi-letter sign having a high contrast, or illuminated, background. The inter-panel strips are particularly adapted for use with reverse-type letters wherein the symbol, e.g., alphanumeric character, on each panel is defined by a transparent portion surrounded by an opaque periphery.

BRIEF DESCRIPTION OF THE DRAWINGS

The appended claims set forth those novel features believed characteristic of the invention. However, the invention itself as well as further objects and advantages thereof, will best be understood by reference to the following detailed description of a preferred embodiment taken in conjunction with the accompanying drawings, where like reference characters identify like elements throughout the various figures, in which:

DESCRIPTION OF THE PREFERRED EMBODIMENT

Figure 1:
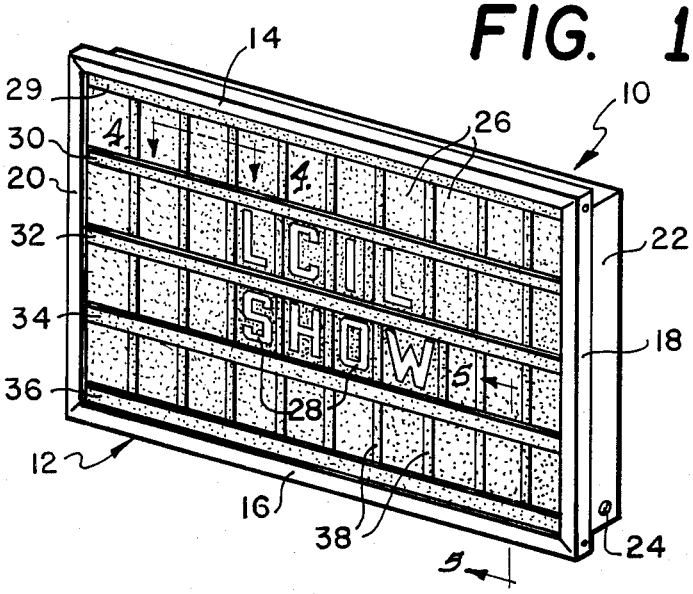
FIG. 1 is a front, upper perspective view of a display sign incorporating the present invention.

Referring to FIG. 1, there is shown an upper perspective view of a display sign 10 embodying the novel features of the present invention.

The display sign 10 includes a sign frame 12 on a forward portion thereof which is comprised of upper and lower frame members 14, 16 coupled to lateral frame members 18, 20 so as to form a generally rectangular structure. Coupled to a rear portion of the sign frame 12 is a generally rectangular, enclosed housing 22 which is open at the front and continuous with sign frame 12. Housing 22 may include an aperture therein 24 through which an electrical supply cord (not shown) may be passed to energize an electrical light source (also not shown in FIG. 1) positioned therein.

Sign frame 12 includes a plurality of generally horizontally oriented rails, or tracks, 29, 30, 32, 34 and 36. Adjacent tracks are separated by removable panels 26 and provide support therefor. Some panels, generally designated as elements 26 in FIG. 1, are opaque and preferably of a uniform, generally dark color. Other panels, generally designated as elements 28, include a symbol thereon, such as an alphanumeric character, represented by a clear, or transparent, portion of the panel surrounded by an opaque panel portion similar to that of opaque panels 26. Laterally positioned between adjacent opaque and letter panels 26, 28 are opaque partitions, or strips, 38, each of which is affixed to a lateral edge of a respective panel as described below. The inter-panel partitions 38 prevent light leaks between adjacent panels resulting in improved individual alphanumeric character clarity and enhanced sign intensity. From FIG. 1, it can be seen that the width of those panels 28 containing an alphanumeric character, or letter, varies and is dependent upon the particular character displayed. For example, a panel displaying a "W" would necessarily be wider than a panel containing the letter "I". By attaching an inter-panel partition 38 to a lateral edge of each panel so as to abut and engage an immediately adjacent panel, inter-panel light leaks are eliminated without the use of vertical spacers, or support bars, in the sign frame as in the prior art, thereby simplifying the construction and reducing the cost of the sign.

Figure 2:
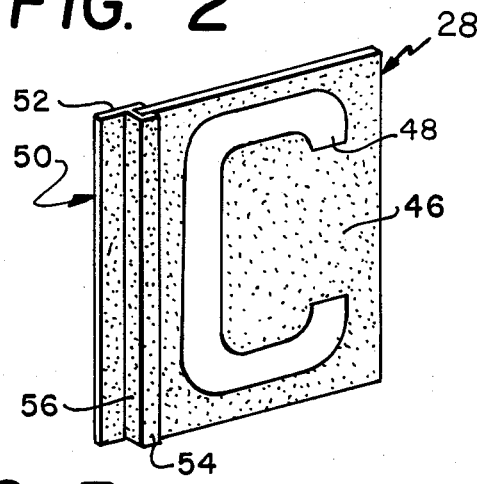
FIG. 2 is a perspective view of a letter panel and attached inter-panel partition in accordance with one embodiment of the present invention.

Referring to FIG. 2, there is shown a perspective view of a character, or letter, panel 28 with a partition, or strip, 50 coupled thereto. Panel 28 includes a clear, or transparent, portion 48 representing a designated alphanumeric character which is encompassed and defined by an opaque portion 46 of the panel. Affixed to a lateral edge of letter panel 28 is an inter-panel partition 50 which includes an aft portion 52, a front portion 54 and an interconnecting portion 56 coupling the aforementioned aft and front portions. From the figure, it can be seen that the aft portion 52 is longer than and aligned generally parallel with the front portion 54 of partition 50, with interconnecting portion 56 aligned generally at a right angle with respect to aft and front portions 52, 54. As shown in FIG. 2, partition 50 has a horizontal cross sectional shape in the form of a small "h". The recessed portion of the "h" of inter-panel partition 50 is securely affixed, such as by means of a conventional epoxy cement, to a lateral edge of the panel 28 along substantially the entire length thereof. A facing lateral edge of an adjacent panel is positioned in contact with the angled surfaces formed by the aft and interconnecting portions 52, 56 of partition 50. Thus, the inter-panel partition 50 serves to seal the inter-panel space in not permitting light to escape from the rear of the letter panel around the edges thereof. In addition, the panel edge to which the partition 50 is affixed is protected from impact damage as might occur if dropped. While partition 50 may be damaged if subjected to a high impact force, it is much less expensive than the panel to which it is affixed and, after being damaged, may be easily replaced with a new partition. In a preferred embodiment, the partitions 50 and panels 26, 28 are comprised of a high impact resistant acrylic resin, or plastic material. The partitions 50 are easily formed by a conventional extruding process. Similarly, sign-quality ink is applied to the front surfaces of the opaque panels 26 and the letter panels 28 so as to form the desired character thereon.

Figure 3:
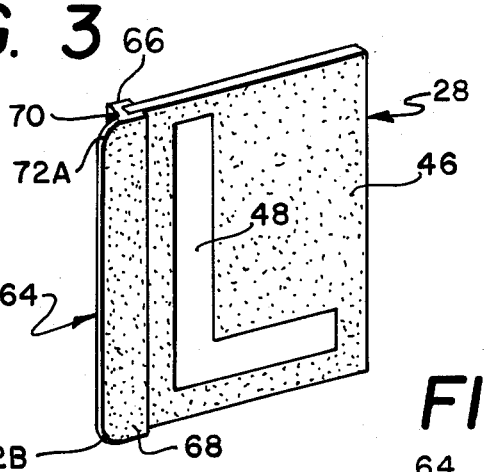
FIG. 3 is a perspective view of a letter panel and attached inter-panel partition in accordance with a second embodiment of the present invention.

Referring to FIG. 3, there is shown a second, preferred embodiment of the present invention. Coupled to character panel 28, which includes a transparent portion 48 defining the letter presented thereon and an opaque portion 46 encompassing the transparent portion, is an inter-panel partition 64. Partition 64 includes an aft portion 66, a front portion 68, and an inter-connecting portion 70 coupling the aforementioned aft and front portions. In this embodiment of the inter-panel partition, the upper and lower corner edges 72A, 72B of the aft portion 66 of the partition are rounded so as to provide an inter-panel partition less likely to be damaged if the panel to which it is affixed is dropped. The rounded corners 72A, 72B of inter-panel partition 64 act to distribute an impact force applied thereto over a greater portion of the inter-panel partition than the partition 50 shown in FIG. 2, and thus make the partition and the panel coupled thereto more damage-resistant. Also in this embodiment, the front portion 68 of partition 64 is longer than the aft portion 66 thereof. Thus, in this embodiment inter-panel partition 64 has been coupled to immediately adjacent panel 28 in a manner reverse to that previously described and as shown in FIG. 2. The manner in which inter-panel partition 64 is attached to character panel 28 as shown in FIG. 3 represents the preferred embodiment of the present invention in that the extended width of front portion 68 of inter-panel partition 64 completely overlaps and seals the inter-panel space and shields the interior of the sign frame in which the character panels are mounted from environmental elements such as moisture, dust, dirt, etc.

Figure 4:
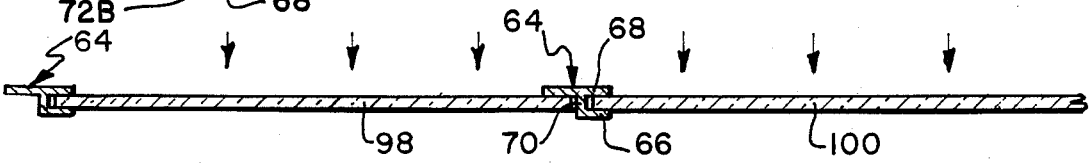
FIG. 4 is a top sectional view taken along sight line 4—4 of a portion of a display sign illustrated in FIG. 1 showing the inter-locking arrangement between adjacent letter panels in accordance with the present invention.

Referring to FIG. 4, there is shown a horizontal sectional view of the sign 10 shown in FIG. 1. FIG. 4 illustrates the coupling of inter-panel partition 64 to immediately adjacent panels 98, 100. A lateral edge of panel 100 is inserted in the recessed portion of inter-panel partition 64. This recessed portion of partition 64 is defined by the aft, front and interconnecting portions 66, 68 and 70 thereof and is securely affixed to the lateral edge portion of panel 100. Adjacent panels such as panel 98 and panel 100 in FIG. 4 are positioned in close proximity to the respective lateral edges of each other and are separated only by the inter-panel partition 64. The lateral edge of panel 98 is positioned in an abutting relation with that portion of inter-panel partition 64 formed of aft and interconnecting portions 66, 70 thereof. The arrows shown in FIG. 4 represent the direction of viewing of an observer of the sign and the panels 98, 100 therein.

Figure 5:
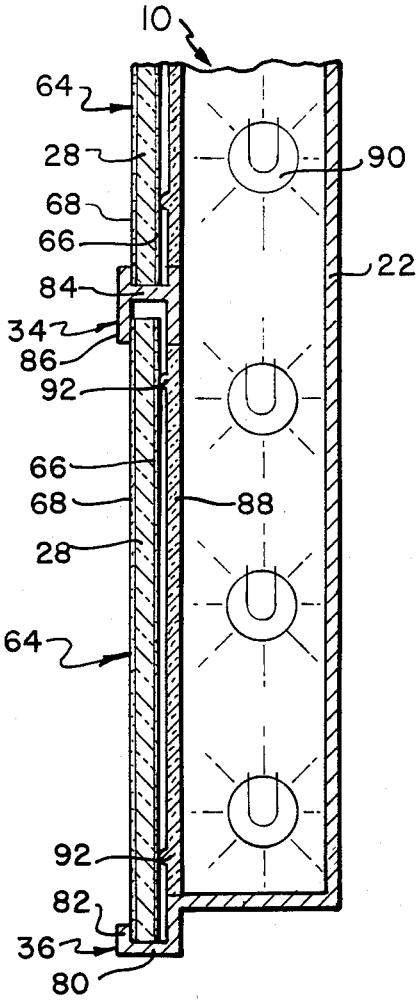
FIG. 5 is a lateral sectional view of a display sign as shown in FIG. 1 taken along sight line 5—5.

Referring to FIG. 5, there is shown a vertical sectional view of the sign 10 shown in FIG. 1. A plurality of light elements 90 are positioned and mounted within sign housing 22 in a conventional manner. The light elements 90 are positioned aft of a background screen, or backing plate, 88 through which the light is transmitted from the light elements 90 to the front of the sign 22. Background screen 88 is securely coupled to the forward periphery of housing 22 so as to form a continuous structure therewith. Positioned along and coupled to background screen 88 are a plurality of vertically arranged and horizontally aligned support panels 80, 84. A character or opaque panel 54 is positioned upon and supported by a respective support panel 80, 84. Coupled to a forward portion of support panel 84 and oriented generally perpendicular with respect thereto is horizontal track 34. Similarly, coupled to a forward portion of support panel 80 and aligned generally perpendicular with respect thereto is horizontal track 36. From FIG. 5 it can be seen that panels 80, 84 provide support for respective panels resting thereupon, while horizontal tracks 34, 36 provide for the stable positioning and retention of a panel upon its respective support panel. As shown in FIG. 5, the panels 54 have a flat front surface and thus may be positioned on the sign by means of a suction-type of device when required such as in an elevated sign. With the lower portion of horizontal track 34 longer than horizontal track 36, the panels are positioned between adjacent tracks using the conventional "lift and fall" technique. The forward surface of background screen 88 may include a plurality of spacers 92 in the form of projections thereupon for engaging a rear portion of the immediately adjacent panel in insuring its stable positioning within the various aforementioned support and retaining panels. However, these spacers 92 are not a part of the present invention as they are not essential for the character panel mounting arrangement described and claimed herein. Positioned immediately rearward of a character panel 28 is the aft portion 66 of an inter-panel partition 64 while immediately forward of the character panel 28 is the front portion 68 of the inter-panel partition 64.

There has thus been shown an improved sign letter mounting which utilizes a strip affixed to a lateral edge of each sign panel to eliminate light leaks between adjacent panels. The inter-panel strips, or partitions, provide impact protection for the panels while simplifying and reducing the cost of sign panel manufacture.

While particular embodiments of the present invention have been shown and described, it will be obvious to those skilled in the art that changes and modifications may be made without departing from the invention in its broader aspects and, therefore, the aim in the appended claims is to cover all such changes and modifications as fall within the true spirit and scope of the invention. The matter set forth in the foregoing description and the accompanying drawings is offered by way of illustration only and not as a limitation. The actual scope of the invention is intended to be defined in the following claims when viewed in their proper perspective based on the prior art.

I claim:

1. In a sign having a plurality of alphanumeric characters of different lateral dimensions, said sign including a generally planar front portion and a plurality of vertically spaced, generally horizontally oriented, parallel support members mounted therein, wherein adjacent support members include respective facing recessed track portions extending the length thereof, a method for displaying said characters comprising:

fabricating a plurality of flat, unitary, generally rectangular panels of different widths having a translucent portion and an opaque portion of a first color surrounding said translucent portion so as to define an alphanumeric character integral with and in the plane of said panel, wherein the width of each panel is determined by the lateral dimension of the alphanumeric character defined thereon;

forming a plurality of h-shaped partitions of said first color, each of said partitions including generally parallel forward and aft members, with said forward member wider than said aft member, and an interconnecting member generally perpendicular to said forward and aft members and coupled to one end of said aft member and to an intermediate portion of said forward member and wherein that portion of said partition comprised of the immediately adjacent surfaces of said forward, aft and interconnecting members is adapted for secure positioning on a single lateral edge of a respective panel in spaced relation from an alphanumeric character thereon;

securely affixing one of said partitions to a lateral edge of a respective panel;

inserting the combination of said panel and partition affixed thereto into the facing recessed track portions of adjacent support members wherein each of said panels and attached partitions is securely maintained in position in a front portion of said sign in a generally planar, aligned array with a forward portion of each of said partitions engaging a panel immediately adjacent to the panel to which it is affixed in an overlapping manner; and positioning a background screen of a second color in high contrast with said first color immediately aft of said panels wherein said background screen is visible from the front of said sign through the translucent portions of said panels so as to provide high definition of said alphanumeric characters but is not visible between immediately adjacent panels where said partitions are positioned.

2. A method in accordance with claim 1 further comprising the steps of forming said background screen from a translucent material and illuminating said background screen from the rear of said sign.

3. A method in accordance with claim 1 wherein the step of forming said partitions includes extruding said partitions from a high strength plastic.

4. A method in accordance with claim 1 further comprising the step of forming the upper and lower portions of each of said partitions located distally from the panel to which the partition is securely affixed in a rounded configuration.

5. A method in accordance with claim 1 wherein said first color is black and said second color is white.

6. A method in accordance with claim 1 wherein the step of affixing a partition to the lateral edge of a respective panel includes applying an epoxy cement to the respective facing edges of the partition and the panel.

* * * * *